United States Patent [19]

Bellinder

[11] 4,074,452

[45] Feb. 21, 1978

[54] KNOCKDOWN LIGHTING BOXES AND MEANS FOR CLAMPING THE FRONT PANELS THEREOF

[76] Inventor: Alex J. Bellinder, 221 Highland Drive, Mundelein, Ill. 60060

[21] Appl. No.: 713,695

[22] Filed: Aug. 12, 1976

[51] Int. Cl.[2] ..... G09F 13/00

[52] U.S. Cl. ..... 40/571; 40/573

[58] Field of Search ..... 40/132 R, 132 A, 133 R, 40/132 D, 125 H, 125 G, 130 R, 152.2

[56] References Cited

U.S. PATENT DOCUMENTS

| | | | |
|---|---|---|---|
| 861,689 | 7/1907 | Wilhems | 40/133 R |
| 1,668,460 | 5/1928 | Manick | 40/132 D |
| 1,673,962 | 6/1928 | Wiley | 40/133 R |
| 2,558,599 | 6/1951 | Wiles | 40/132 R |
| 2,823,475 | 2/1958 | Packard | 40/130 R |
| 3,418,738 | 12/1968 | Goodman | 40/130 R |
| 3,500,569 | 3/1970 | Simmons | 40/132 R |

FOREIGN PATENT DOCUMENTS

| | | | |
|---|---|---|---|
| 586,155 | 11/1959 | Canada | 40/132 D |

*Primary Examiner*—Samuel W. Engle
*Assistant Examiner*—Ralph Palo
*Attorney, Agent, or Firm*—Vogel, Dithmar, Stotland, Stratman & Levy

[57] ABSTRACT

A plurality of light boxes adapted to be transported and stored in a knocked-down and disassembled condition to be readily assembled, set up and connected together, with a divider between adjacent light boxes and with a front translucent panel for each light box which is lit up by lights within each light box. Each translucent panel having a flange, with the flanges of the adjacent panels being held in abutting relationship by clamping means which eliminates mullions therebetween and with the clamping means so constructed to eliminate and/or reduce the shadows on the panels at such junctures. The adjacent panels presenting when lighted a continuous surface where the dividing lines between adjacent panels are substantially imperceptible.

10 Claims, 9 Drawing Figures

20
24
24'
30
31
31.
35
36
37
38
40
54
58
59
62
70
73
74
75
78
78'
80
82
84
86
88
90

KNOCKDOWN LIGHTING BOXES AND MEANS FOR CLAMPING THE FRONT PANELS THEREOF

BRIEF SUMMARY OF THE INVENTION

One of the objects of this invention is to provide means for connecting the front panels of a plurality of light boxes so that the front panels present a front surface which is not interrupted by a mullion or the like at the abutting edges of the front panels. The front surface of the plurality of panels presents a continuous evenly lighted front surface which appears as an integral panel and where the dividing lines between adjacent front panels are substantially imperceptible. In addition, the clamping means for clamping adjacent front panels is so constructed that shadows at such junctures are eliminated and the light passing through the front panels from the interior of the several connected light boxes is uniform and devoid of shadows and dark areas.

Another object of this invention is to provide a plurality of light boxes which are transported and/or stored in a disassembled and a knocked-down condition and may be readily and quickly assembled by an inexperienced person for display.

DESCRIPTION OF THE PREFERRED EMBODIMENTS

The light box units are adapted to be shipped in knocked-down condition and assembled at the point of display. When assembled, a minimum of two light box units are connected and with no limit as to the maximum number of light boxes that may be connected. For purposes of illustration, three light boxes are shown connected and the description with respect to same will suffice for two or any other number of connected units.

Figure 2:
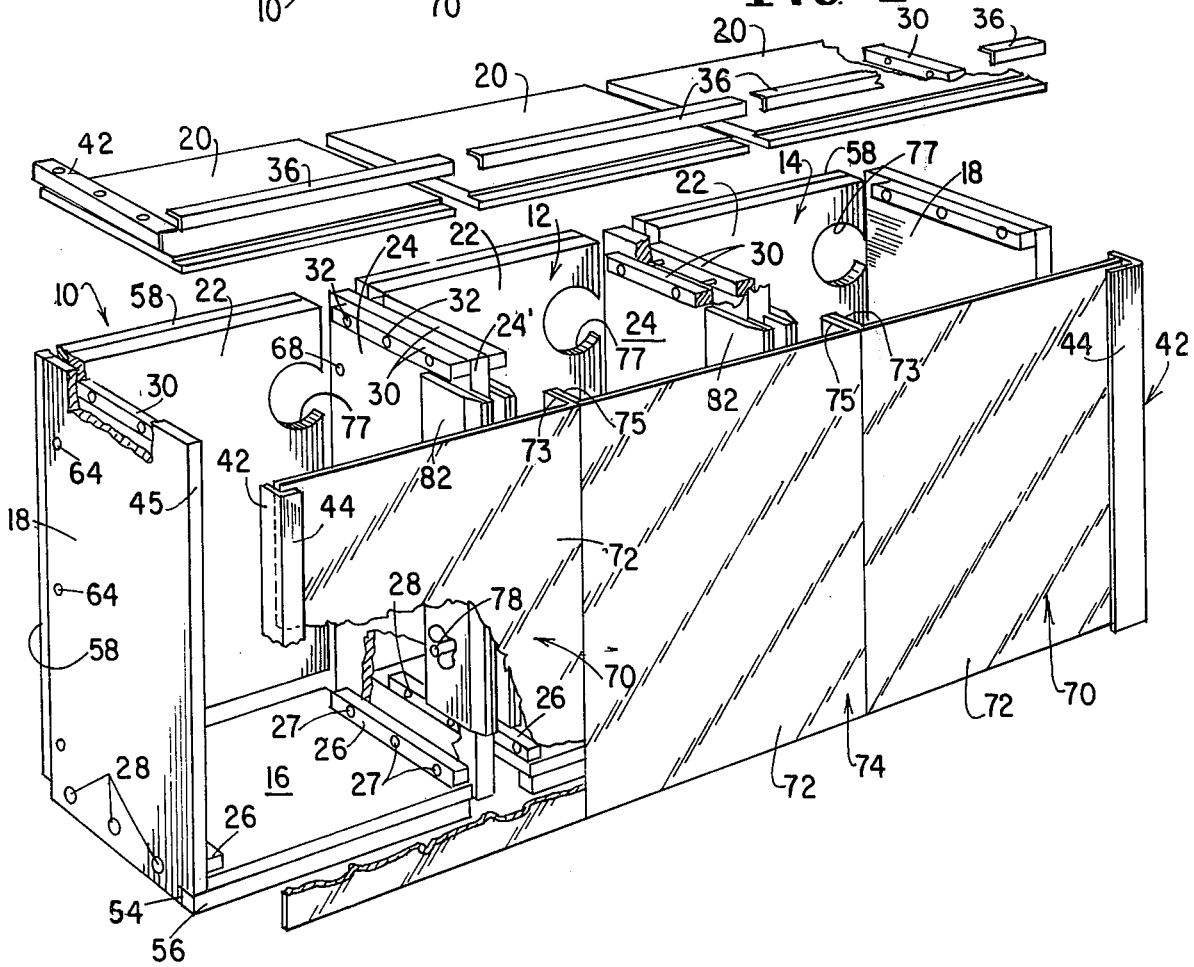
FIG. 2 is a perspective exploded view of the three light boxes in assembled relation.

The light box units are generally designed as 10, 12 and 14. Light box unit 10 comprises a bottom wall or base 16, a left end wall 18, a top 20 and a rear wall 22. A divider or partition generally indicated at 24 is positioned between two adjacent connected units and if two adjacent units are formed, such as 10 and 12, a single divider or partition 24 is used between them. If three units are connected, then a second divider identical to divider 24 would be used between light box units 12 and 14, as best seen in FIG. 2. If a fourth light box unit is employed, an additional divider would be used. In the case of the three light box units illustrated, the two dividers 24 form the opposite sides for the intermediate light box unit 12, as well as one of the inner sides for the first and third units 10 and 14. Another end wall 18 on the right side completes the row of units whether there are two, three, four or more units combined and each light box unit has a bottom wall 16, a top 20 and a rear wall 22. Identical parts for each unit will be given identical numbers as the same parts are used to form two or more units in a row.

The upper surface of the bottom wall or base 16 has a base cleat 26 fixedly secured thereto adjacent each of the sides of the base 16. Each said cleat has a plurality of spaced openings (preferably three) 27 which are to be aligned with similarly spaced openings 28 in the end wall 18 and openings 25 in the divider 24 for receiving fastening bolts 29 and wing nuts 29' for securing the parts together as will be subsequently described. When secured, the bottom of the end wall 18 and divider 24 rest on the floor and support the base 16 above the floor.

Figures 5, 6, 7, 8, 9:
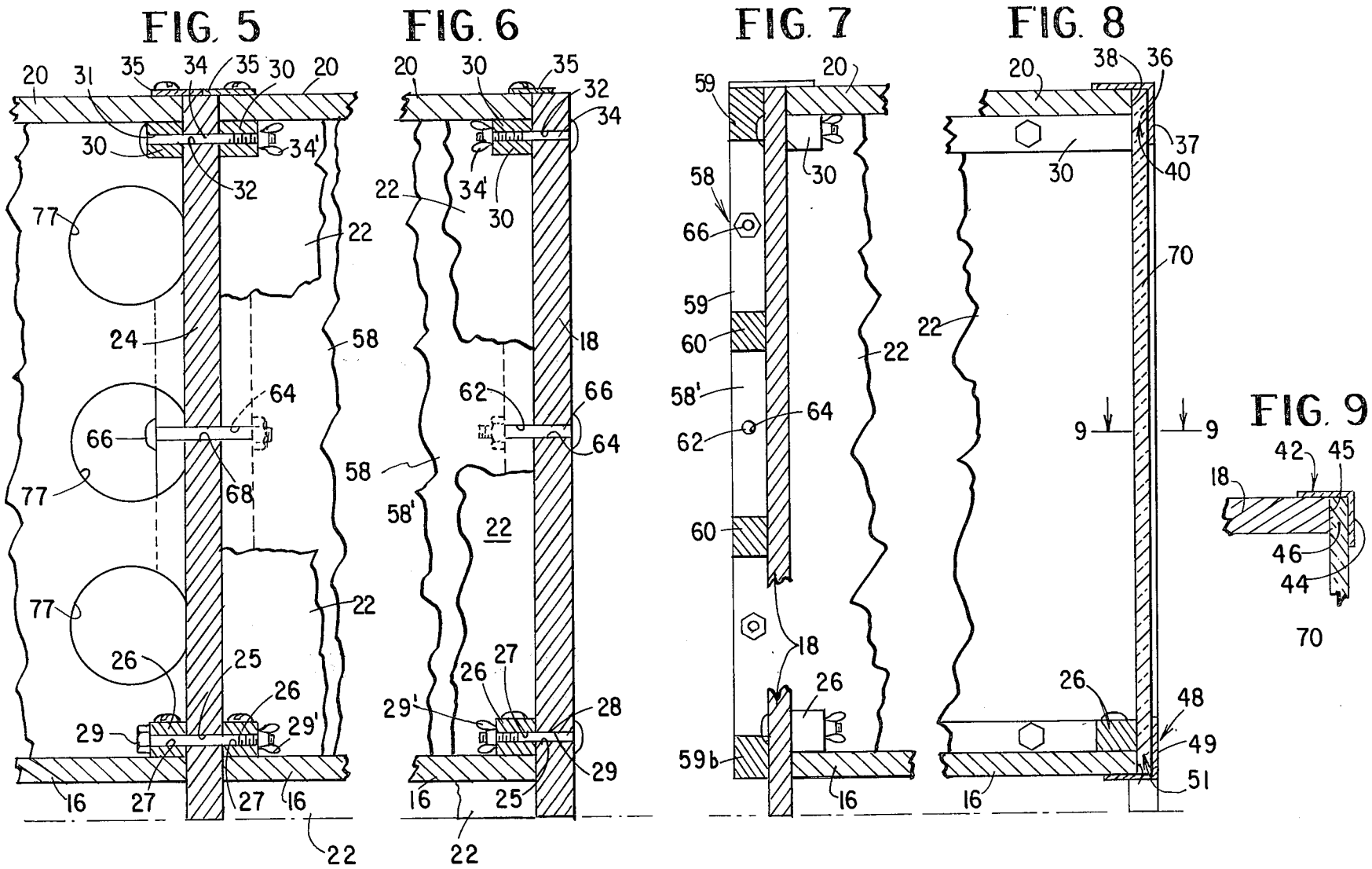
FIG. 5 is a sectional view taken on lines 5—5 of FIG. 1.
FIG. 6 is a sectional view taken on lines 6—6 of FIG. 1.
FIG. 7 is a sectional view taken on lines 7—7 of FIG. 1.
FIG. 8 is a sectional view taken on lines 8—8 of FIG. 1.
FIG. 9 is a sectional view taken on lines 9—9 of FIG. 8.

The top wall or cover 20 has a cleat 30 fixedly secured to the underside thereof adjacent each of the opposite sides thereof. The cleats 30 each have a plurality of spaced openings 32 (preferably three) which are to be aligned with similarly spaced openings 32 in the end wall 18, openings 32 in the divider 24 for receiving fastening bolts 34 and wing nuts 34' for securing the parts together. One cleat 30 of the top 20 will be positioned against the end wall 18 (FIG. 6) with the opposite cleat 30 of the top 20 positioned against the divider 24 (FIG. 5). As best seen in FIG. 5, the two adjacent units 12 and 14 are secured together, both secured to the divider 24 therebetween. The bolts 34 pass through the two top cleats 30 each secured to a separate top 20 and also pass through the opening 32 in the divider. This secures the top of the divider. At the bottom, the bolt 29 passes through the two aligned openings 27 in the two cleats 26 each secured to a bottom 16 and through the opening 25 in the divider 24 and is secured by a wing nut 29'. This secures two adjacent bottoms to the divider. As shown in FIG. 6, the end wall 18 is secured to the cleat 30 of the top 20 by other bolts 34 and wing nuts 34'. At the bottom, bolts 29 extend through openings 28 in end wall 18 and are secured to cleat 26 on the base by wing nuts 29', thus securing one bottom 16 to the end wall.

Fixedly secured to the opposite side of each of the tops or covers 20 are metal strips 35 which extend outwardly of the opposite sides of the top or cover 20. These overhanging strips 35 are adapted to rest on the top of the end wall 18 (FIG. 6) and the top of the divider 24 (FIG. 5) and be supported thereon.

The top or cover 20 has a horizontally positioned right-angled metal strip 36 fastened with machine screws 36' to the top at the front end thereof (FIGS. 3 and 8), but the downwardly extending vertical portion 37 of the strip is spaced from the front edge 38 of the top 20 to provide a horizontal space 40 therebetween to receive the upper end of the front panel to be described.

The end wall 18 has a vertically positioned right-angled metal strip 42 fixedly secured to the end wall adjacent the front thereof (FIGS. 2 and 9) with the inwardly extending front portion 44 of the strip 42 spaced from the front edge 45 of the end wall to provide a vertical space 46 therebetween to receive the outer end of the front panel.

The bottom wall or base 16 likewise has a horizontally positioned right-angled metal strip 48 (FIG. 8) fixedly secured thereto at the front thereof and the upwardly extending front portion 49 thereof is spaced from the front edge 50 of the base 16 to provide a space 51 to receive the bottom end of the front panel.

In this manner the front panels adjacent the end walls 18 are secured within the top horizontal space 40 of the top 20, the bottom horizontal space 51 of the bottom 16 and the end vertical space 46 of the end wall 18.

The bottom of end walls 18 rest on the floor surface; however, the bottom wall or base 16 of each unit is secured through the bottom wall cleats 26 to the end wall and to the divider and each said base 16 is positioned above the floor surface, as best seen in FIGS. 5 through 8.

Figure 1:
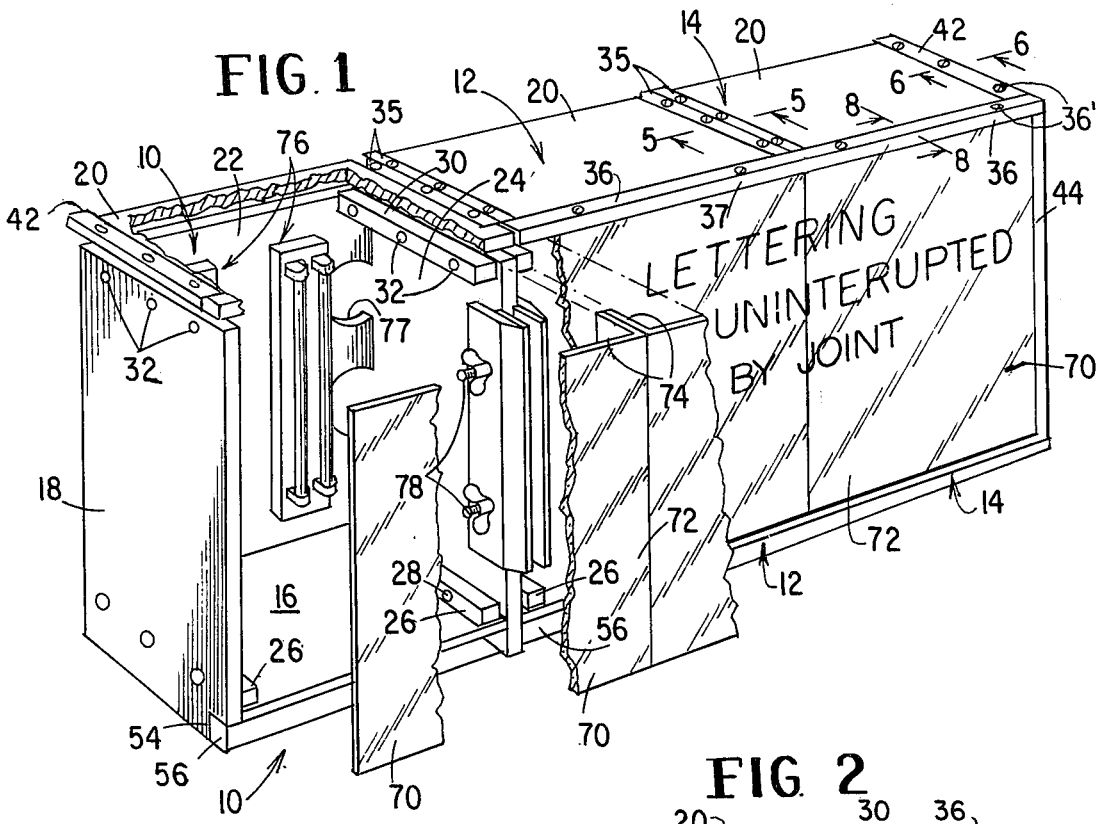
FIG. 1 is a view showing three light boxes in assembled relation with one of the light boxes shown in an exploded view.

The end walls 18 are recessed (FIGS. 1 and 2) as at 54 at the lower front thereof and a wooden kick plate 56 is secured to the end wall and fits within the recess 54 and extends across the bottom of each unit.

The rear wall 22 of each unit has fixedly secured thereto a rearwardly extending frame (FIG. 7) generally indicated at 58 which has spaced sides 59 and connecting top and bottom 59*a* and 59*b*. Extending between the spaced sides 59 of the frame are spaced cross strips 60. The frame and cross strips also serve to rigidify the rear wall. The spaced sides 59 of the frame 58 have openings 62 which are aligned with spaced openings in the end wall and in the divider to secure the rear wall to said end wall and divider. The spaced openings 62 are aligned with spaced openings 64 in the end walls 18 and adjacent the rear thereof and through which the fastening bolts 66 extend to secure the rear wall 22 to the end wall 18. The bottom of the rear wall 22 rests on the floor surface. The opposite side 59 of the frame is likewise provided with similar spaced openings 64 to align with the openings 68 in the divider 24 and to receive fastening bolts 66 to secure the opposite side 59 of the rear wall to the divider. Wing nuts 66' are secured to the fastening bolts.

The front panels are formed of a translucent plastic material to permit the light to pass through from the interior of the light box. The translucent front panels at each of the opposite ends, namely for the end units 10 and 14, are each indicated by the numeral 70 and are identical in that each has a front portion 72 and a right-angled flange 73 at one edge. The intermediate panel or intermediate panels indicated by the numeral 74 such as for unit 12 has a right-angled flange 75 at each of its opposite edges. Every front panel which would be intermediate the opposite end front panels has a right-angled flange at each of its edges, while the front panels which are positioned to form the end light boxes have only a single flange along its inner edge.

Each of the rear walls 22 supports a plurality of lighting fixtures generally indicated at 76 here shown in the form of fluorescent lighting tubes suitably mounted on a bracket, which, in turn, are attached to the rear wall 22 and are electrically connected through conducting wire to any outlet plug wherever same are to be used. The rear wall of each of the light box units has a plurality of spaced enlarged openings 77 adjacent one of the sides sufficiently large to accommodate the insertion of a hand. In addition, the top wall has small openings therein (not shown) to dissipate the heat within the units.

Figures 3, 4:
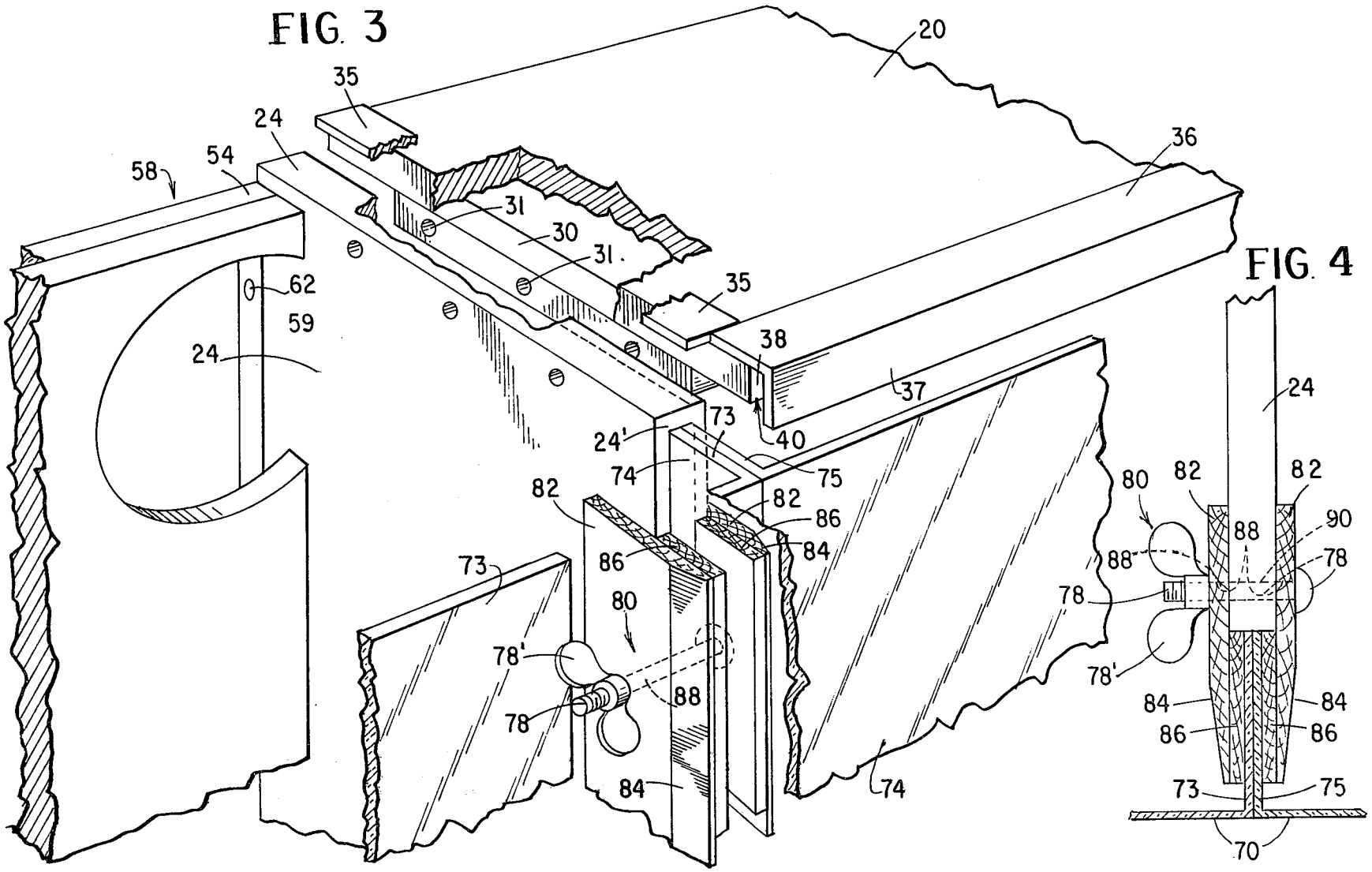
FIG. 3 is an enlarged exploded view of portions of the light box particularly showing the divider and the clamping means.
FIG. 4 is a sectional view showing the clamping means secured to the divider (in full lines) and connecting two adjacent front panels.

The front end panels 70 are positioned so that the right-angled flanges 73 thereof abut the flanges 75 of the intermediate panel 74 as best seen in FIGS. 2 and 4. Secured by means of fastening elements, such as bolts 78 and wing nuts 78', are clamping means generally indicated at 80 and best shown in FIGS. 3 and 4, which comprise a pair of strips of wood 82 each having a beveled front edge 84. Each clamping strip 82 has fixedly secured to the inside thereof another strip 86. The clamping strips 82 each have a plurality of transverse openings 88 which are aligned with spaced openings 90 adjacent the front of the divider 24 and through which the threaded fastening bolts 78 are inserted, which is then secured by the wing nut 78'. The flanges 73 and 75 of the adjacent panels 74 and 70 are in abutting relationship as best seen in FIG. 4 and when the wing nut 78' is tightened on the bolt 78, the wood strips 82 hug the divider 24 and the wood strips 86 engage the flanges of the panels and hold them together as best shown in FIG. 4 so that the two adjacent front panels appear at their joint as a continuous panel with an uninterrupted front surface. The top, bottom and outer edges of each of the end front panels 70 rest in the spaces 40, 51 and 46, respectively. The top and bottom edges of the intermediate panel 74 rest in the spaces 40 and 51. The rear edges of the flanges 73 and 75 will abut against the front edge of the divider 24. If only two light boxes are connected, such as for example units 10 and 14, then the second divider 24 will be eliminated as will the intermediate front panel 74 and the other parts forming the intermediate unit, and the flanges 73 of each of the end panels 70 will be connected in abutting relationship.

Uniform fastening means in the form of the threaded bolts and wing nuts previously described are provided to secure the parts together throughout, thereby standardizing the fastening means, except for the top right angle metal strips 36 which are fastened with machine screws 36'.

The beveled front ends 84 of the clamping strips 82 prevent shadows on the front panels 70 and 74 when same are illuminated. Thus, when the front panels 70 and 74 are secured edge to edge as shown in FIG. 2, there are no mullions between adjacent front panels and the front surface appears as a continuous uninterrupted lighted front surface with no shadows or lines between the panels. The continuous front panels may have a sign printed thereon extending across the length thereof with no interruptions, or transparencies may be mounted or hung on the front panels.

The preferred size of each light box unit is approximately 8 ft. high with a width across the front of each of approximately 39 inches. Thus, when several of such units are assembled, a large illuminated front surface is presented. The sizes of the light box units may, however, be smaller or larger than the foregoing.

It will be seen that the clamping means 80 can be tightened after the front translucent panels are initially positioned between the clamping members. The tightening is accomplished through the rear openings 77 by inserting the hand therein and then engaging the wing nuts so that they may be tightened on their bolts. Thus, the front panels may be clamped after the light box units are assembled and the clamping is done through the rear.

The parts forming the spaced end walls, rear wall, top and bottom and divider and the cleats are preferably formed of wood or the like.

From the foregoing it will be clear that the parts are shipped and/or stored in a knocked-down condition and are readily assembled by connecting the parts as previously described by standardized bolts and wing nuts without the use of any tool or extraneous fastening means, except for securing the top right angled strips 36 with machine screws as previously described. Thus, a large display of light box units can be shipped and stored in a knocked-down condition in a minimum space and readily and quickly assembled by an inexperienced person. It can likewise be quickly and readily disassembled for subsequent and repeated use.

What is claimed is:

1. A plurality of light boxes adapted to be transported and/or stored in a knocked-down and disassembled condition to be assembled, set up, and connected together, comprising spaced end walls, a rear wall, top and bottom members and a divider between each pair of adjacent light boxes, a front panel for each light box, each front panel having a flange at right angles to the plane of the panel, clamping means including a pair of elongated strips connected by fastening means engaging the flanges of adjacent front panels for securing the adjacent flanges on adjacent panels together, said strips having beveled edges to eliminate shadows on the associated front panels so that the front panels are connected to each other free of exterior mullions therebetween to present a continuous front panel surface, and lighting means positioned inside each said light box for illuminating said front panels.

2. A structure as set forth in claim 1 in which division between adjacent connected front panels is substantially imperceptible so that said connected panels give the appearance of a continuous front panel.

3. A structure as set forth in claim 1, wherein the interior dividers forming adjacent light boxes are removable to vary the size and number of light boxes in the overall structure.

4. A structure as set forth in claim 1 in which said clamping means are accessible through an opening in the rear wall of the light box.

5. A structure as set forth in claim 1 in which the front panels are formed of a translucent plastic material.

6. A structure as set forth in claim 1 in which said strips engage the flanges of adjacent front panels and the rear edges of the flanges engage the front of the divider.

7. A structure as set forth in claim 6 in which the front edge of each of the clamping strips is beveled.

8. A structure as set forth in claim 1 in which the bottom and top each have cleats with openings therein which align with openings in the end wall and divider and through which the fastening means extend for detachably securing said parts together.

9. A structure as set forth in claim 8 in which the end wall, top and bottom have right-angled strips secured to the front of each in spaced relation thereto to provide spaces to receive the top, bottom and outer end of each of the front panels.

10. A structure as set forth in claim 9 in which the front panels are formed of a translucent material.

* * * * *